US006301777B1

(12) United States Patent
Sigler et al.

(10) Patent No.: US 6,301,777 B1
(45) Date of Patent: Oct. 16, 2001

(54) APPLICATOR DIE FOR WIRE-TO-TERMINAL ASSEMBLY

(75) Inventors: Phillip D. Sigler, Mt. Green; Nathan J. Dickamore, Ogden; Kelly C. Thomas, North Ogden, all of UT (US)

(73) Assignee: Autoliv Asp, Inc., Ogden, UT (US)

( * ) Notice: Subject to any disclaimer, the term of this patent is extended or adjusted under 35 U.S.C. 154(b) by 0 days.

(21) Appl. No.: 09/441,010

(22) Filed: Nov. 16, 1999

(51) Int. Cl.[7] ..... H01R 43/04

(52) U.S. Cl. ..... 29/753; 29/566.2; 29/33.14; 29/748; 72/470

(58) Field of Search ..... 29/753, 861, 566.2, 29/33 M, 863, 748, 751, 755, 761, 763; 72/470, 441

(56) References Cited

U.S. PATENT DOCUMENTS

| | | | | |
|---|---|---|---|---|
| 4,707,913 | * | 11/1987 | Moline | 29/753 |
| 4,805,278 | * | 2/1989 | Bulanda et al. | 29/33 M |
| 4,821,383 | * | 4/1989 | Grosklos et al. | 29/33 M |
| 4,959,988 | | 10/1990 | Dassance . | |
| 4,970,889 | | 11/1990 | Phillips . | |
| 5,033,187 | * | 7/1991 | Gloe et al. | 29/753 |
| 5,074,033 | | 12/1991 | Dassance . | |
| 5,095,599 | | 3/1992 | Gloe . | |
| 5,131,124 | * | 7/1992 | Skotek | 29/33 M |
| 5,174,022 | | 12/1992 | Phillips . | |
| 5,337,589 | | 8/1994 | Gloe . | |
| 5,483,739 | | 1/1996 | Smith . | |
| 5,517,749 | | 5/1996 | Zuin . | |
| 5,575,061 | * | 11/1996 | Tsuji et al. | 29/863 |
| 5,577,318 | | 11/1996 | Smith . | |
| 5,625,942 | | 5/1997 | Casey . | |
| 5,737,830 | | 4/1998 | Yeomans . | |
| 5,745,982 | * | 5/1998 | Klinedinst | 29/753 |
| 5,752,405 | | 5/1998 | Gerst . | |
| 5,901,440 | * | 5/1999 | Maeda et al. | 29/863 |
| 5,909,913 | * | 6/1999 | Fitz, Jr. et al. | 29/753 |
| 5,937,510 | | 8/1999 | Seiersen . | |
| 6,026,562 | * | 2/2000 | McMillin et al. | 29/748 |

* cited by examiner

*Primary Examiner*—Carl J. Arbes
*Assistant Examiner*—Minh Trinh

(57) ABSTRACT

An applicator die for crimping open loop type terminals to wire leads comprising applicator housing, a plurality of blades and a plurality of housing. An applicator housing is provided which is extended or retracted vertically in response to an applicator force applied thereto. An insulation blade housing with an insulation blade and a core blade housing, with a core blade are movingly disposed inside the applicator housing. Prior to a crimping operation, the applicator housing is retracted and a terminal is moved into position and aligned with the insulation and core blades. A lead wire is also positioned inside the terminal. As the applicator housing descends in response to the applicator force, it pushes the lead wire down into contact with the terminal. A cam lever, acting under the influence of the applicator force, moves a cam vertically, bringing together complementary members of an insulation anvil and a core anvil. As the complementary members of the insulation anvil come together, they pinch the terminal to prevent movement of the terminal during crimping. As the applicator housing descends, the insulation blade housing and core blade housing move from the first position to slidingly embrace the insulation and core anvils. The core blade and insulation blade reach the second or extended position in which they crimp the terminal to a lead wire.

22 Claims, 8 Drawing Sheets

APPLICATOR DIE FOR WIRE-TO-TERMINAL ASSEMBLY

BACKGROUND OF THE INVENTION

1. The Field of the Invention

The present invention relates generally to a method and apparatus for securely attaching a terminal to a conducting wire. More particularly, embodiments of the present invention relate to an improved applicator die that reliably establishes and maintains the terminal in a desired orientation during processing positively releases the wire/terminal assembly after crimping is complete.

2. The Prior State of the Art

A multitude of approaches have been taken to address the problem of connecting an electrical wire to a terminal component. Some approaches focus on a connecting means formed on or in the terminal component. Typically, these connecting means are adapted to receive the bare end of a conducting wire. That is, no special treatment to the end of the wire is required to form the desired electrical connection. One example of such a connecting means is an electrically conductive post about which a wire is wrapped. Typically, the post is threaded so that a nut can advance down the post so as to pinch the wire between the nut and a plate at the bottom of the post. Another example of a connecting means adapted to receive a bare wire is found in light switches and audio speakers. These devices typically employ an orifice partially closed off by a spring-loaded conductor. In operation, the bare wire is inserted into the orifice, pushing the spring-loaded conductors aside. Once the wire is fully inserted, the spring force exerted by the spring-loaded conductors acts to retain the wire in place.

While the 'bare wire' type of electrical connectors is still preferred for certain applications, it is recognized that in other applications, it would be desirable to modify the end of the wire in some way so as to achieve a desired type of connection. Specifically, it is desired to attach to the end of the conducting wire a terminal that is adapted to readily mate with a corresponding connector on an electrical component. To that end, a wide variety of terminal types have been developed. A typical terminal comprises an opening in which a conducting wire is inserted, and a connecting portion integral with the structure of the opening. The opening is usually in the form of a closed loop (also known as a "barrel"), or an open loop.

Obviously, however, the terminals needed to be reliably secured to the conducting wire. Selection of a method or methods for securing terminals is driven by two primary considerations. First, the connection must be mechanically strong and reliable so that thermally induced expansion and contraction does not compromise the performance of the wire/terminal assembly. Furthermore, a mechanically strong connection ensures that the wire will not pull out of the terminal if either the wire or terminal is subjected to stress. Second, the method used to connect the terminal to the conducting wire must produce substantial and reliable physical contact between the conducting wire and the terminal. Substantial and reliable physical contact is essential for optimum electrical conductivity, and thus, the performance of the wire/terminal assembly.

There are a wide variety of methods currently employed to attach a terminal to a conducting wire. Known methods include soldering and crimping. Crimping essentially involves imposing a force on the opening of the terminal so as to deform the opening of the terminal about the conducting wire, thus securing the conducting wire therein. Crimping terminals to conducting wires is particularly desirable because the process is easily automated and results in a strong mechanical connection between the terminal and the wire.

In many cases, the crimping of the terminal to the wire has become an automated process that permits rapid production of a large number of wire/terminal assemblies. The ability to rapidly attach the terminal to the conducting wire is of particular interest in view of the large number of wire/terminal assemblies required by industries such as the automotive industry. Given the high volume of wire/terminal assemblies that are used, it has been, and remains, a desirable goal to maximize the quality and production rates by refining the crimping processes to eliminate steps and/or equipment that are inefficient or tend to slow production and/or degrade quality.

A terminal may be crimped to a conducting wire using a variety of methods. Crimping is typically accomplished by using a crimp blade and anvil configuration, collectively referred to as an 'applicator die.' In operation, the opening of the terminal is placed on the anvil, and a conducting wire is inserted into the opening of the terminal. The crimp blade then descends and applies a force to the terminal opening, deforming the structure of the terminal opening around the conducting wire. The geometry of the crimp thus formed is varied by changing the shape of the contacting surfaces of the anvil and/or the crimp blade. A common geometry that is currently used is one where the crimp blade has a substantially V-shaped notch formed therein so that the wide end of the notch opens downward towards the anvil. Correspondingly, the anvil has a mating V-shaped protrusion that extends upwards and is aligned with the notch in the crimp blade.

Typically, the terminal opening comprises an open loop. The open side of the loop is placed facing upwards and the closed side of the loop reposes on the anvil. Thus, as the crimp blade descends on its downstroke, the walls of the notch contact the sides of the loop and push them inward and down around the connecting wire. The crimp blade has a surface of predefined geometry that imposes a desired shape on the crimp as the blade descends. For example, one type of a crimp blade has a surface geometry configured as to produce a crimp with a cross-section substantially in the shape of a 'B.' Thus, the anvil and crimp blade cooperate to form a strong and secure mechanical connection between the terminal and the conducting wire.

While the anvil and crimp blade crimping machinery and method are generally effective, they, and other known crimping methods and machinery, suffer from a variety of significant shortcomings. One major problem with known crimping process is that the typical anvil and/or die is generally ineffectual in constraining the terminal during the crimping process itself. Accordingly, the terminal is relatively free to move and change position, with respect to the crimp blade and anvil, during the crimping process. Because close alignment between the crimp blade, anvil, and terminal is critical to a sound mechanical connection between the terminal and the connecting wire, any tendency or ability of the terminal to move during the crimping process will degrade the quality of the mechanical connection that is produced and will likely also compromise the electrical performance of the connection. For example, if multiple wires are inserted into a terminal and the terminal rotates or otherwise moves before or during crimping, some of the wires can partially withdraw from the terminal. Thus, the electrical performance of the wire/terminal assembly may be compromised. Furthermore, an out of position terminal may result in an offset crimp in which the crimped terminal grasps only a portion of the wire to which the terminal is connected. Again, such a result compromises the electrical performance and mechanical soundness of the connection, and would thus serve as grounds for rejecting the wire/terminal assembly that has been produced.

Another related problem with current methods of performing the crimping process also concerns the geometry of the known crimp blade and anvil configurations. The problem relates specifically to the relationship between the crimp blade and the anvil when the crimp blade is fully lowered to the crimping position. In particular, the crimp blade and anvil cooperate to define a space when the crimp blade is fully lowered. The shape of the space in turn defines the cross-sectional shape of the crimped wire/terminal assembly. In a typical crimp blade and anvil configuration, there is a gap between the upper corners of the anvil and the interior walls of the V-shaped notch of the crimp blade into which the anvil fits during crimping. Thus, during crimping, the crimp blade tends to push or extrude a portion of the terminal past the upper corners of the anvil and into the gap.

Extrusion of the terminal is undesirable because it results in the formation of stress cracks in the interior of the terminal. Typically such stress cracks form near the extruded portions of the terminal. Stress cracks will ultimately cause the connection to fail. This issue is of particular concern in applications such as motor vehicle air bag systems where the dependable performance of electrical components is absolutely essential. Unfortunately, the stress cracks currently cannot be detected by the visual inspection processes typically used in industry. Detecting the stress cracks requires the use of destructive inspection techniques such as cutting a cross-section through the crimp. Obviously, such destructive detection techniques would be counter-productive if applied to every wire/terminal assembly. Consequently, stress crack failures of wire/terminal assemblies often go undetected until a failed assembly is inspected.

Another significant problem with known crimping devices relates to the notch in the crimp blade. Typically, this notch describes an angle of about 3°. However, because of the small angle, terminals often become stuck inside the notch after crimping. No further crimping can be accomplished with the crimp blade until the notch is cleared. Time spent clearing the notch slows down the production process and reduces the number of crimped wire/terminal assemblies that can be produced in a given time frame. Obviously, this is an undesirable result, especially in view of the need, previously noted, for a high volume production rate of these assemblies.

A related problem concerns the coating on a typical terminal. In particular, it is recognized that the mechanical and electrical performance of a wire/terminal assembly can be greatly improved by combining a soldering step with the crimping step. The terminals used in known crimping process are typically pre-coated with tin or the like so that when the crimped assembly is heated, the tin pre-coat will melt, or flow, to form a metal-to-metal bond between the terminal and the conducting wire. While pre-coating terminals is thus a desirable technique, the tin coating is problematic in the context of known crimping devices and techniques. In particular, the tin is relatively soft, as it must be in order to flow properly when heated. However, because the tin is soft and easily deformed by the crimp blade, the tinned terminals frequently stick in the crimp blade after the crimping process. Further, some of the tin coating rubs off on the blade. Consequently, after a period of time tin builds up on the blade and contributes to the sticking problem. The tin coating present on the typical terminal thus tends to exacerbate the sticking problem.

Although sticking of the wire/terminal assembly in the crimp blade is a problem that has plagued the industry for some time, current crimping machines and processing methods are generally ineffective in reducing or preventing the problem. In fact, the typical crimping machine only aggravates the situation further. Specifically, current conventional crimping devices employ a 'knock-out' which is intended to forcibly eject the wire/terminal assembly from the crimp blade after crimping is completed. A gripper then withdraws the wire/terminal assembly. However, when the wire/terminal assembly is stuck in the crimp blade, the knock-out frequently fails to eject the terminal. Thus, the gripper can only withdraw the stuck wire/terminal assembly by applying an impulsive force that acts to forcibly jerk the wire/terminal assembly from the crimp blade. Unfortunately, there is a high potential that this jerking force may compromise the mechanical integrity of the connection between the wire and the terminal. Visual inspection of wire/terminal assemblies which have been forcibly jerked from the crimp blade generally fails to reveal the resulting defects. Thus, known crimping devices are particularly insidious in that they may induce defects in the wire/terminal assembly that readily escape detection. Consequently, the defect generally becomes apparent only upon analysis of a failed wire/terminal assembly.

At least one attempt has been made to prevent wire/terminal assemblies from becoming lodged in the crimp blade after crimping. In particular, known crimping processes commonly employ some type of lubrication scheme whereby a lubricant such as oil is introduced onto the surfaces of the crimp blade. While this approach is somewhat effective in eliminating the sticking problem, known lubrication methods cause some undesirable side effects. The most undesirable side effect relates to the fact that some of the lubricant used to lubricate the crimp blade inevitably finds its way into the wire/terminal assembly. The lubricant, in the context of the wire/terminal assembly, is a contaminant. Over time, the lubricant creates corrosion and a build-up of oxides between the wire and terminal which undesirably increases the resistance of the wire/terminal assembly as a whole. As with the jerking problem, the introduction of lubricant into the wire/terminal assembly ultimately causes defects that are not readily detectible at the time of assembly.

Finally, at least one other problem with known applicator dies and crimping methods is the relatively short useful life of the typical crimp blade. Typically, the crimp blade becomes worn with use, for example, by excessive scoring. Because a conventional crimp blade cannot be renewed so as to prolong its life, it must be replaced at regular intervals, usually at considerable cost.

In view of the foregoing problems with applicator dies and crimping methods that are currently available, an improved crimping process and device, particularly an improved applicator die, are needed. Specifically, the applicator die should define a crimp space geometry that precludes extrusion of the terminal and the attendant stress cracking. Further, the applicator die should securely grasp the terminal so as to prevent the terminal from rolling or moving out of position prior to or during the crimping process. Also, the applicator die should be prevent terminals from sticking in the die, and thereby obviate the need to lubricate the crimping surfaces of the crimp elements and to forcibly jerk the terminal from the applicator die after crimping. Finally, it would be desirable that the applicator die be durable and have renewable parts so as to foreclose the recurrent and expensive need to install replacement parts.

OBJECTS AND SUMMARY OF THE INVENTION

The present invention has been developed in response to the current state of the art, and in particular, in response to these and other problems and needs that have not been fully or completely solved by the currently available crimping processed and devices used therein.

It is an object of the present invention to provide a crimping method and device for securing a terminal to a conducting wire in such a way as to produce a high quality connection in a cost-effective manner.

It is another object of the present invention to provide a crimping device that will prevent the terminal from moving during the crimping process.

Another object of the present invention is to provide a crimping process and device that will reduce the number of defective conducting wire/terminal assemblies while permitting high production rates.

Another object of the present invention is to provide an improved applicator die for use in a crimping process wherein a terminal is secured to a conducting wire.

It is a further object of the invention to provide an applicator die configured to securely hold the terminal so as to prevent the terminal from rolling or moving out of position prior to or during the crimping process.

A further object of the present invention to provide an applicator die for use in a crimping process that is configured so that after crimping process is complete the wire/terminal assembly is positively released thereby eliminating sticking of the wire/terminal assembly and/or jerking of the assembly from the applicator die.

Finally, it is an object of the invention to provide an applicator die having strong and durable blades and anvils so as to prevent premature wear and reduce replacement costs.

Additional objects and advantages of the invention will be set forth in the description which follows, and in part will be obvious from the description, or may be learned by the practice of the invention. The objects and advantages of the invention may be realized and obtained by means of the instruments and combinations particularly pointed out in the appended claims.

To achieve the foregoing objects, and in accordance with the invention as embodied and broadly described herein, a crimping applicator with an improved applicator die for use in crimping processes is provided. In one embodiment, the applicator die will be used to crimp open loop type terminals about lead wires or the like. Embodiments of the present invention are particularly suitable for use in applications wherein the open loop terminal has at least two crimping sections for attaching to a lead wire having insulation stripped from an end thereof. One crimping section is adapted to receive the stripped portion of the lead wire while an integral abutting crimping section is adapted to receive at least part of the insulated portion of the lead wire that abuts the stripped portion.

In one embodiment, a crimping applicator employing the inventive applicator die includes an applicator housing that moves downward in response to application of an applicator force by an applicator ram. The downward motion of the applicator housing, in turn, transmits a force to one end of a cam lever pivotally mounted to a pivot shaft so that the other end of the cam lever, engaged with a cam, moves the cam upward to an extended position in response to the applicator force. When the applicator force is released, the applicator housing is retracted upwards and the cam is returned to a retracted position.

In one embodiment, the crimping applicator includes an insulation anvil and a core anvil that are operably engaged by the cam. The insulation and core anvils each comprise a pair of complementary members that move between a first position and a second position in response to a corresponding motion of the cam. The force imposed on the core anvil and the insulation anvil by the cam causes the complementary members of the anvils to come together so as to securely grip a terminal prior to crimping.

Further, one embodiment of the present invention includes an insulation blade and a core blade, each confined in a respective housing. The respective housings are fixed within the applicator housing so as to move in unison therewith. As the applicator housing descends in response to the applicator force, the insulation blade housing and core blade housing releasably engage the insulation anvil and core anvil so as to ensure that the complementary members of the anvils maintain their grip on the terminal before and during crimping. The insulation blade and core blade are received in the anvils substantially simultaneously with the engagement of the anvils by the insulation blade housing and core blade housing. As the insulation blade and core blade reach an extended or first position in the anvils, they transmit the applicator force to the terminal so as to crimp the terminal about a wire.

Upon completion of the crimping process, the applicator force is released and the applicator housing, blade housings, and blades are retracted to the second position. Substantially simultaneously, the cam is retracted so as to move the complementary members of the anvils apart and thereby release the crimped wire/terminal assembly. The crimping applicator and applicator die are thus made ready for another crimping process.

These and other objects, features, and advantages of the present invention will become more fully apparent from the following description and appended claims, or may be learned by the practice of the invention as set forth hereinafter.

BRIEF DESCRIPTION OF THE DRAWINGS

In order to more fully understand the manner in which the above-recited and other advantages and objects of the invention are obtained, a more particular description of the invention will be rendered by reference to specific embodiments thereof which are illustrated in the appended drawings. Note particularly that the appended drawings are not necessarily drawn to scale. Understanding that these drawings depict only typical embodiments of the invention and are not therefore to be considered to be limiting of its scope, the invention and its presently understood best mode for making and using the same will be described and explained with additional specificity and detail through the use of the accompanying drawings in which.

DETAILED DESCRIPTION OF AN EMBODIMENT OF THE INVENTION

Reference will now be made to figures wherein like structures will be provided with like reference designations. It is to be understood that the drawings are diagrammatic and schematic representations of one embodiment of the invention, and are not to be construed as limiting the present invention. Nor are the drawings necessarily drawn to scale.

Figure 1:
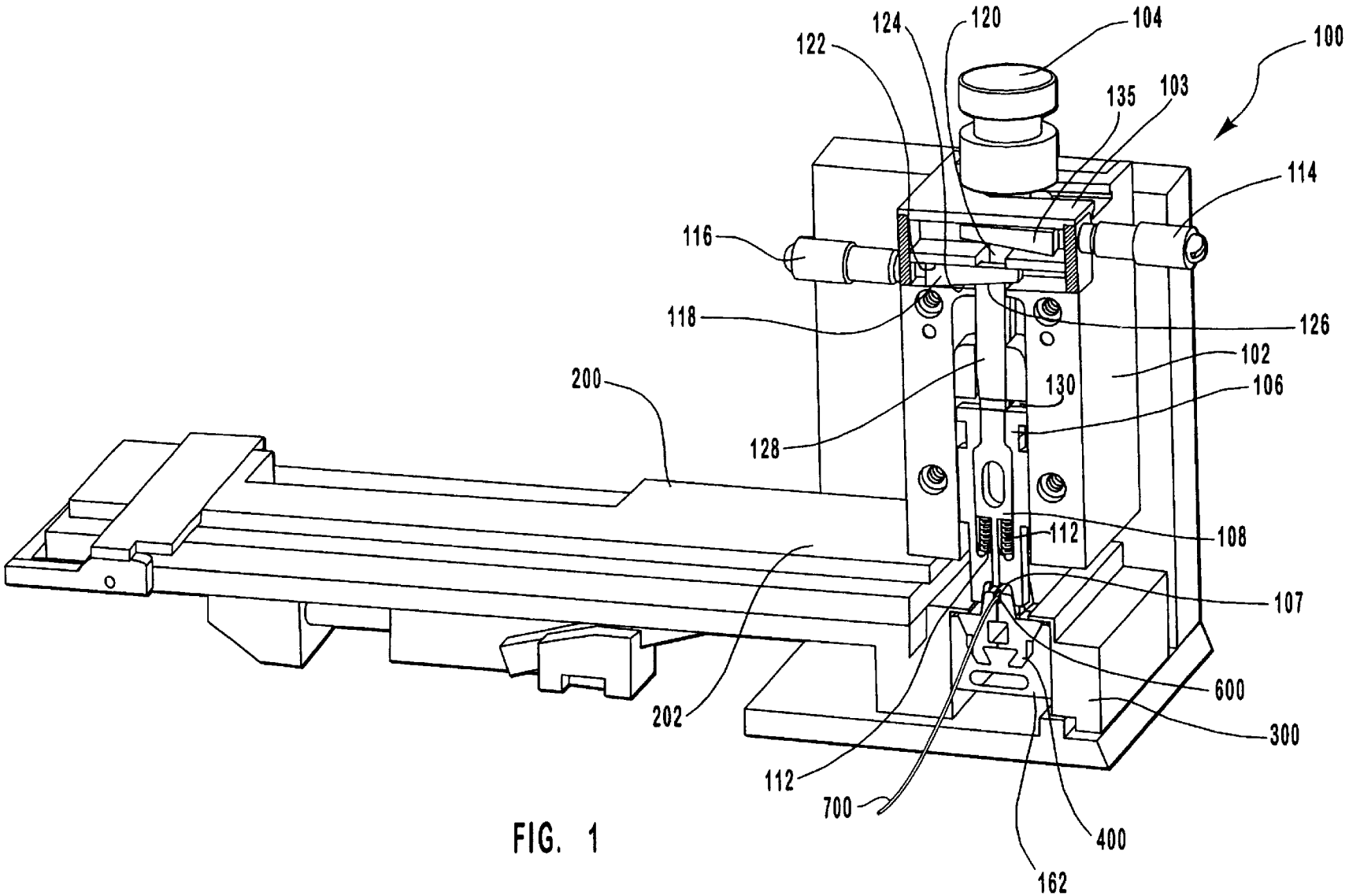
FIG. 1 is a perspective view of one embodiment of the inventive applicator die incorporated into crimping applicator. For clarity, the end walls of the applicator housing and cam housing are removed.

The present invention relates to an applicator die for use in crimping terminals to conducting wires. FIGS. 1 through 5*b* indicate various embodiments of an applicator die conforming to the teachings of the invention. One embodiment of a crimping applicator is generally indicated in FIG. 1 as 100. Crimping applicator 100 includes an applicator housing 102 and is located at the terminal end 202 of a feed table 200. In one embodiment, applicator housing 102 comprises a steel material or the like. For example, in one embodiment applicator housing 102 is composed of 4140 steel. It will be appreciated that various other steel alloys and other types of materials could be used for applicator housing 102.

Located at remote end 103 of applicator housing 102 is an adapter head 104. Adapter head 104 is configured to be engaged by a applicator ram (not shown) or the like so that movement of the applicator ram exerted on adapter head 104 causes a corresponding vertical motion of applicator housing 102. In particular, an applicator force from the applicator ram (not shown) transmitted downward through the adapter head 104 causes applicator housing 102 to move out of its retracted position, downward a predetermined distance towards a cam housing 300 (discussed in greater detail below), and into an extended position as depicted in FIG. 1. In analogous fashion, retraction of the applicator ram (not shown) causes applicator housing 102 to move away from cam housing 300 back into a retracted position.

The applicator ram is one embodiment of a means for applying applicator force to a crimping applicator 100. Structure capable of performing the function of applying an applicator force to a crimping applicator 100 may include, by way of example and not limitation, a hydraulic system or the like. Further, the present invention contemplates as within its scope that the applicator forces produced and/or transmitted by a variety of means including, but not limited to, mechanical, electromechanical, pneumatic systems and the like, as well as combinations thereof.

Figure 2:
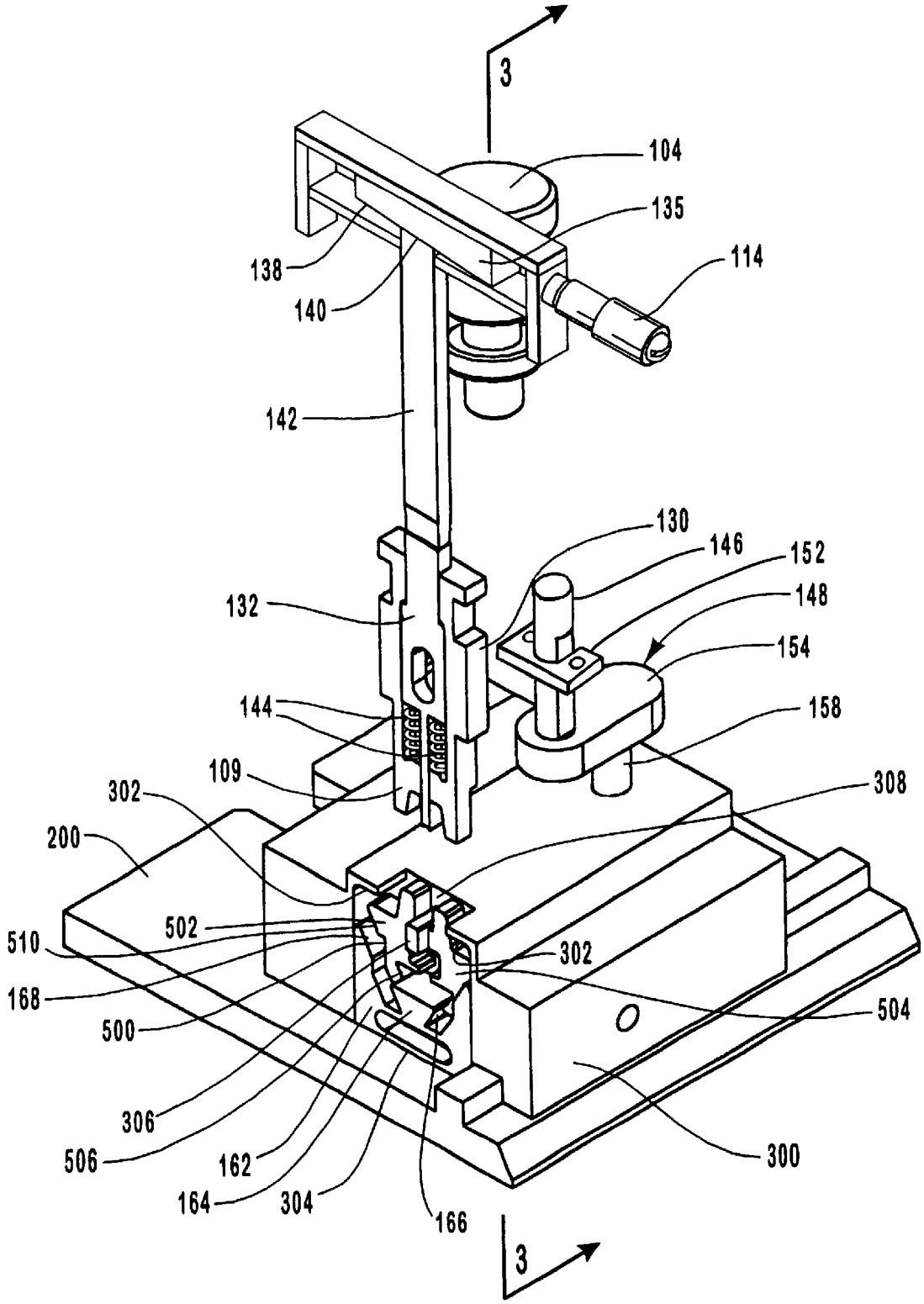
FIG. 2 is a partial perspective view depicting one embodiment of the core anvil and core blade of the applicator die of FIG. 1.

With continuing reference to FIG. 1 and referring also to FIG. 2, an insulation blade housing 106 and a core blade housing 130 (see FIG. 2) are fixed inside applicator housing 102 so as to move in unison therewith. While not specifically indicated in FIGS. 1 and 2, core blade housing 130 is mounted directly behind insulation blade housing 106. An insulation blade 108 is slidingly confined inside a slot formed in insulation blade housing 106. In similar fashion, a core blade 132 (FIG. 2) is slidingly confined inside core blade housing 130. In one embodiment, insulation blade 108 and core blade 132 (FIG. 2) comprise S7 tool steel or the like. It will be appreciated by one skilled in the art that insulation blade 108 and core blade 132 (FIG. 2) may be composed of various other materials as well.

Insulation blade 108 and core blade 132 are held in normally retracted positions by resilient members 112 and 144 (FIG. 2), respectively. In one possible embodiment, resilient members 112 and 144 comprise pre-compressed springs or the like. When the applicator force is applied to adapter head 104, core blade 132 (FIG. 2) and insulation blade 108 move substantially in unison with applicator housing 102 in response. As discussed in detail below, the maximum downward extension, or 'height' of core blade 132 (FIG. 2) and insulation blade 108 may be individually selected and adjusted, thereby permitting an offset between the height of core blade 132 (FIG. 2) and insulation blade 108.

Insulation blade housing 106 includes a cutout at terminal end 107 calculated to slidingly embrace an insulation anvil, indicated generally as 400, as insulation blade housing 106 descends. Likewise, as depicted in FIG. 2, core blade housing 132 has a cutout at terminal end 109 thereof also configured to slidingly embrace a core anvil, indicated generally as 500, as core blade housing 132 descends. It will be appreciated that terminal ends 107 and 109 may assume whatever configuration is necessary to facilitate cooperation with insulation anvil 400 and core anvil 500, respectively. In one embodiment, terminal ends 107 and 109 comprise U-shaped cutouts.

As further indicated in FIGS. 1 and 2, insulation anvil 400 and core anvil 500 are at least partially confined inside cam housing 300 and are aligned with insulation blade 108 and core blade 132. Insulation anvil 400, core anvil 500, insulation blade 108, and core blade 132 collectively comprise what is herein referred to as an 'applicator die.' In FIG. 1, a cam housing cover has been removed for purposes of clarity.

Referring to FIG. 1, insulation anvil 400 and core anvil 500 (FIG. 2) cooperate to securely retain a terminal 600. In one embodiment, terminal 600 is of the open loop type. As insulation blade 108 and core blade 132 (FIG. 2) descend under the influence of the applicator force, a lead wire 700 is inserted into the open loop terminal 600 by means well known in the art. At about the same time, terminal ends 107 and 109 (FIG. 2) of insulation blade housing 106 and core blade housing 130, respectively, slidingly embrace insulation anvil 400 and core anvil 500, respectively, so as to ensure that the respective anvils remain in position during crimping. The engagement of insulation blade housing 106 and core blade housing 130 with insulation anvil 400 and core anvil 500 also ensures precise alignment of insulation blade 108 and core blade 132 with respect thereto.

Insulation blade 108 and core blade 132 (FIG. 2) continue to descend until applicator housing 102 reaches its extended position. Applicator housing 102 is operably connected with cam 162 so that as applicator housing 102 descends under the influence of the applicator force, cam 162 causes insulation anvil 400 and core anvil 500 (FIG. 2) to move upwards inside cam housing 300 so as to be in position to receive, respectively, insulation blade 108 and core blade 132 (FIG. 2) preparatory to crimping. Similarly, when the applicator force is released, cam 162 is retracted and moves insulation anvil 400 and core anvil 500 (FIG. 2) to a retracted position inside cam housing 300.

As applicator housing 102 moves into its extended position, insulation blade 108 and core blade 132 are received by insulation anvil 400 and core anvil 500 (FIG. 2), respectively, and transmit the applicator force to terminal 600, thereby crimping terminal 600 about lead wire 700. As discussed in further detail below, terminal 600 generally comprises an insulation segment and a core segment so that as insulation blade 108 and core blade 132 descend, insulation blade 108 crimps the insulation segment of terminal 600 about an insulated portion of lead wire 700, and core blade 132 crimps the core segment about a stripped portion of lead wire 700. Upon completing the crimping, the applicator force is released from adapter head 104, and applicator housing 102, and thus insulation blade 108 and core blade 132 return to their respective retracted positions.

The height of the crimp that is formed may be adjusted by a variety of means. Core blade height adjuster 114 and insulation blade height adjuster 116 are one embodiment of structure capable of performing the function of crimp height adjustment. It should be understood that this structure is presented solely by way of example and should not be construed as limiting the scope of the present invention. In one embodiment, the core blade height adjuster 114 and insulation blade height adjuster 116 each comprise a micrometer head or the like operatively connected to a cam. Micrometer heads are particularly desirable in view of the fact that they are configured to provide an infinite number of cam positions. Accordingly, in the present invention, an infinite number of heights of core blade 132 (FIG. 2) and insulation blade 108 can be set as desired.

As illustrated in FIG. 1, insulation blade height adjuster 116 is attached to an insulation blade cam 118 by threads or the like so that rotation of insulation blade height adjuster 116 causes insulation blade cam 118 to advance or retreat along a path defined by an insulation blade cam enclosure 120. Insulation blade cam 118 has an upper cam surface 122 that is contact with the ceiling of the insulation blade cam enclosure 120, and a lower inclined cam surface 124 in sliding contact with an inclined surface 126 of an insulation blade height press 128.

As indicated in FIG. 1, insulation blade height press 128 is in contact with insulation blade 108 so, for example, as insulation blade cam 118 advances, lower inclined cam surface 124 of insulation blade cam 118 exerts a downward force on inclined surface 126 of insulation blade height press 128. The downward force exerted on inclined surface 126 in turn causes insulation blade height press 128, and thus insulation blade 108, to move downward in insulation blade housing 106. By raising or lowering insulation blade 108 with respect to applicator housing 102, the distance traveled by insulation blade 108, and thus the height of the crimp produced, is readily adjusted.

Resilient members 112 act to resist downward movement of insulation blade 108 inside insulation blade housing 106 so that when insulation blade cam 118 retreats in response to input from insulation blade height adjuster 116, resilient members 112 tend to push insulation blade 108 upward inside insulation blade housing 106. While FIG. 1 depicts two resilient members 112, it will be appreciated that various other numbers of resilient members 112 could be used. For example, a resilient member 112 could be slidingly disposed around a portion of insulation blade 108 within insulation blade housing 106. In similar fashion (see FIG. 2), core blade height press 142 is in contact with core blade 132 so, for example, as core blade cam 135 advances, lower inclined cam surface 138 of core blade cam 135 exerts a downward force on inclined surface 140 of core blade height press 142. The downward force exerted on inclined surface 140 in turn causes core blade height press 142, and thus core blade 132, to move downward in core blade housing 130.

As further indicated in FIG. 2, resilient members 144 act to resist downward movement of core blade 132 inside core blade housing 130 so that when core blade cam 135 retreats in response to input from core blade height adjuster 114, resilient members 144 tend to push core blade 132 upward inside core blade housing 130. While FIG. 2 depicts two resilient members 144, it will be appreciated that various other numbers and configuration of resilient members 144 could be used. For example, a resilient member 144 could be slidingly disposed over a portion of core blade 132 within core blade housing 130.

In one embodiment, core blade height adjuster 114 and insulation blade height adjuster 116 comprise a steel alloy or the like having a strength suited to their purpose. By way of example and not limitation, core blade height adjuster 114 and insulation blade height adjuster 116 may be comprised of A2 tool steel. It will be appreciated by one skilled in the art that various other materials could be used. Additionally, core blade height press 142 and insulation blade height press 128 may comprise a steel alloy or the like. In one embodiment, core blade height press 142 and insulation blade height press 128 may be composed of S7 tool steel. It will also be appreciated by one skilled in the art that various other metals and alloys thereof could be used.

Figure 3:
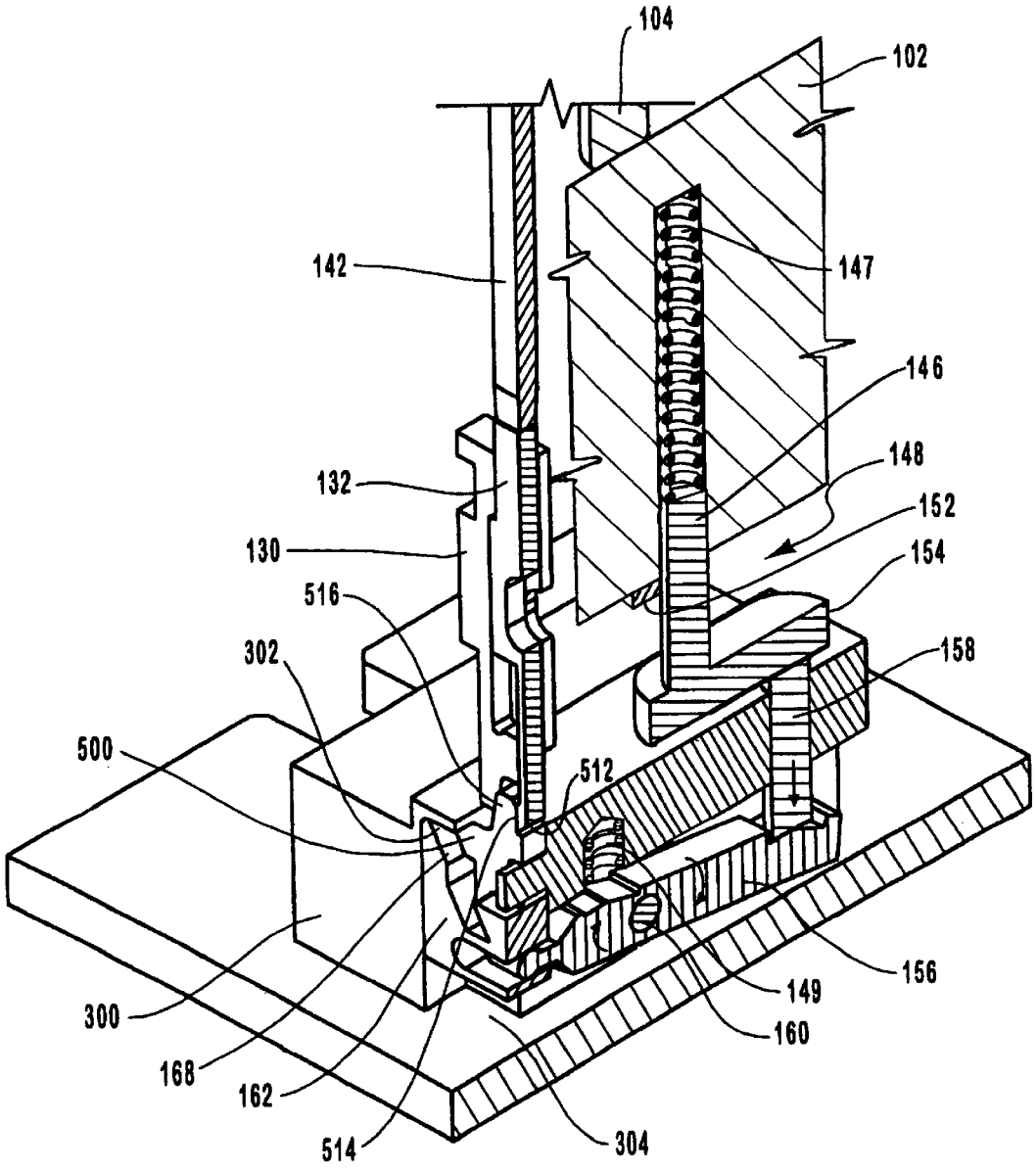
FIG. 3 is a partial cross-sectional perspective view of the structure of FIG. 2 taken along the section line 3—3 therein.

As previously noted, application of the applicator force to adapter head 104 causes insulation blade 108 (FIG. 2) and core blade 132 to descend towards insulation anvil 400 and the core anvil 500. Substantially simultaneously, application of the applicator force causes insulation anvil 400 and core anvil 500 to move into position for crimping. The arrangement shown in FIG. 3 is one embodiment of structure capable of performing the function of moving insulation anvil 400 and core anvil 500 in response to application and release of the applicator force. It should be understood that the structure depicted in FIG. 3 is presented solely by way of example and should not be construed as limiting the scope of the present invention.

Turning now to FIG. 3, when the applicator force is exerted on applicator housing 102, a force is transmitted to a press shoe assembly 148 comprising a spring loaded push rod 146 and a press shoe 154. In one embodiment, spring loaded push rod 146 and press shoe 154 are integral with each other. The upper end of spring loaded push rod 146 is slidably received in applicator housing 102, spring 147 or the like being confined between the upper end of spring loaded push rod 146 and applicator housing 102. In one embodiment, spring 147 requires application of a force of about 800 pounds to achieve full compression. Note that while one embodiment of the present invention employs a spring 147, this invention contemplates as within its scope a variety of mechanical and/or electromechanical devices that would provide the same functionality as spring 147, including, but not limited to, a pneumatic arrangement employing a cylinder or the like whose movement can be controlled with air pressure.

When applicator housing 102 is in the extended position (see FIG. 1), spring 147 urges spring loaded push rod 146 of press shoe assembly 148 out of applicator housing 102, press shoe 154 of press shoe assembly 148 thus maintaining contact with cam lever push rod 158 slidably received in cam housing 300. As applicator housing 102 moves downward in response to application of the applicator force, applicator housing 102 more fully receives spring loaded push rod 146 of press shoe assembly 148, and in so doing, gradually compresses spring 147.

As is well known, the force exerted by springs generally increases proportionally with the distance the spring is compressed. Thus, as spring 147 is gradually compressed under the influence of the applicator force transmitted to it by applicator housing 102, spring 147 responds by exerting an ever increasing force on press shoe assembly 148. Press shoe assembly 148 in turn transmits an ever increasing force, via press shoe 154, to cam lever push rod 158, overcoming the opposing force exerted on cam lever 156 by restoration spring 149. Cam lever 156 accordingly rotates so as to move cam 162 to an extended position inside cam housing 300, as indicated in FIG. 3.

The other critical function performed by spring 147 concerns the movement of applicator housing 102 relative to the motion and positioning of cam 162. In particular, as applicator housing 102 continues downward when cam 162 has been moved to an extended position, spring 147 will admit of further compression. That is, even after cam 162 has reached its extended position, spring 147 permits applicator housing 102 to continue to descend towards insulation anvil 400 (FIG. 1) and core anvil 500 (FIG. 3) preparatory to crimping. Spring 147, sequentially, causes upward movement of cam 162 to an extended position, and then permits continued downward motion of applicator housing 102. As a result of this arrangement, the anvils are positively and reliably moved into position before crimping occurs.

As applicator housing 102 moves to a retracted position after crimping, the force exerted on cam lever 156 by spring 147, via press shoe assembly 148 and cam lever push rod 158, is released. Restoration spring 149 then acts to rotate cam lever 156 so as to move cam 162 to a retracted position inside cam housing 300.

With regard to the range of motion of cam 162 under the influence of cam lever 156, FIG. 3 indicates that cam 162 is substantially the same width as the inside of cam housing 300. Accordingly, movement of cam 162 is restricted essentially to vertical motion. In one embodiment, cam housing 300 confines cam 162 to a vertical range of motion bounded by an extended position wherein cam 162 contacts ceiling 302 of cam housing 300 in response to the applicator force, and a retracted position where cam 162 rests on floor 304 of cam housing 300 once the applicator force is released.

In one embodiment, cam 162 achieves an extended position prior to core blade 132 and insulation blade 108 (FIG. 1) reaching their respective extended positions. However, it is contemplated that various other timing arrangements, such as one wherein cam 162 moves vertically upward just prior to the time that core blade 132 and insulation blade 108 (FIG. 1) achieve their extended position(s), may be used and are considered to be within the scope of the present invention.

Figure 4A:
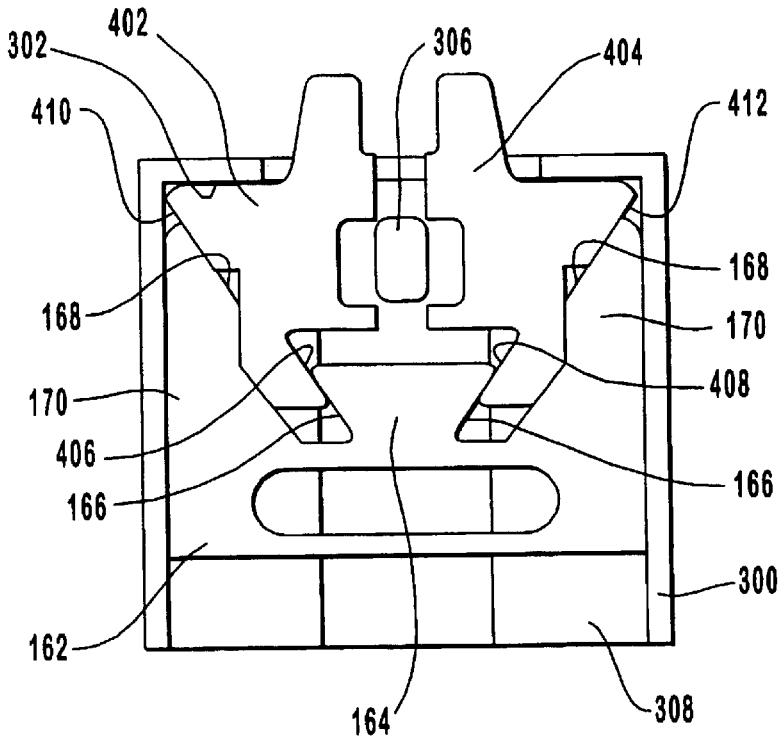
FIG. 4*a* is a partial elevation view of the complementary members of the insulation anvil just prior to being moved together under the influence of the cam.

Specific details of the operation of cam 162 with respect to the present invention can be understood more clearly with reference to FIGS. 4*a* through 4*e*. In FIG. 4*a*, cam 162 is depicted in a partially extended position. Operably engaged with cam 162 are a first complementary member 402 and a second complementary member 404 of insulation anvil 400. Although not shown in FIG. 4*a*, a first complementary member 502 and a second complementary member 504 of core anvil 500 are located immediately behind insulation anvil 400, and similarly engaged with the cam 162 (see FIG. 2). Therefore, although the following discussion is directed toward first and second complementary members 402 and 404 of insulation anvil 400, it is equally applicable to first and second complementary members 502 and 504, respectively, of core anvil 500.

As cam 162 moves from the retracted position to the extended position, under the influence of cam lever 156 (FIG. 3), first and second complementary members 402 and 404 of insulation anvil 400 are pushed upwards towards ceiling 302 of cam housing 300 (see FIG. 4A). The upper limit on the vertical travel of first complementary member 402 and second complementary member 404 is defined by ceiling 302 of the cam housing 300.

In one embodiment, illustrated in FIG. 4*a*, first complementary member 402 and the second complementary member 404 of insulation anvil 400 are mirror images of each other. However, it will be appreciated that these members could, individually and/or collectively, assume a variety of other configurations which would be equally well suited to interact with cam 162 and engaging member 164 so as to provide the desired functionality. These other configurations are accordingly contemplated as being within the scope of the present invention. The same applies with equal force to first and second complementary members 502 and 504, respectively, of core anvil 500 (see FIG. 2).

In one embodiment, first and second complementary members 402 and 404, respectively, of insulation anvil 400, and first and second complementary members 502 and 504, respectively, of core anvil 500 are comprised of a steel alloy or the like. By way of example and not limitation, first and second complementary members 402 and 404, respectively, of insulation anvil 400 and first and second complementary members 502 and 504, respectively, of core anvil 500 are composed of S7 tool steel. It will be appreciated by one skilled in the art that various other materials could also be used. Further, there is no requirement that the complementary members of insulation anvil 400 and core anvil 500 be comprised of the same materials.

With more specific reference now to the engagement of first complementary member 402 and second complementary member 404 of insulation anvil 400 by cam 162, FIG. 4*a* indicates that cam 162 has an engaging member 164 projecting upward therefrom. In one embodiment, engaging member 164 is substantially trapezoidal in shape. Inclined sides 166 of engaging member 164 are in sliding contact with first control surface 406 and second control surface 408 of insulation anvil 400. Similarly, the inclined surfaces 168 at the terminal ends of the arms 170 of the cam 162 are in contact with a third control surface 410 and a fourth control surface 412 of the insulation anvil 400. It will be appreciated that cam 162 is likewise simultaneously cooperating with a similarly configured core anvil (FIG. 2). Various other shapes of engaging member 164 can be used as long as it is configured to cooperate with insulation anvil 400 and arms 170 of cam 162.

When cam 162 is not fully extended, first complementary member 402 and second complementary member 404 are held in a spread-apart configuration, as indicated in FIG. 4*a* (see also FIG. 5*b*), by center post 306 extending out from end wall 308 of cam housing 300. As cam 162 moves upward to the extended position, inclined surfaces 168 of arms 170 of cam 162 exert a force on first control surface 410 and second control surface 412 of the insulation anvil 400, moving first complementary member 402 and second complementary member 404 upwards towards ceiling 302 of cam housing 300. Because center post 306 maintains first complementary member 402 and second complementary member 404 in a spread-apart configuration cam housing 300 prevents outward lateral movement of those respective members, only a vertical component of the force exerted by inclined surfaces 168 is efficacious with regard thereto.

As suggested above, the motion of first complementary member 402 and second complementary member 404 of insulation anvil 400, and the motion of first complementary member 502 and second complementary member 504 of core anvil 500 (FIGS. 2 and 3), is restricted entirely to the vertical direction by center post 306 until first complementary member 402 and second complementary member 404 of insulation anvil 400 and first complementary member 502 and second complementary member 504 of core anvil 500 contact ceiling 302 of cam housing 300. At that point, further vertical movement is prevented.

Accordingly, inclined surfaces 168, aided by ceiling 302 of cam housing 300, are able to move first complementary member 402 and second complementary member 404 of insulation anvil 400 only with the horizontal component of the force imposed by cam 162. The horizontal component of the force imposed by cam 162 acts to move first complementary member 402 and second complementary member 404 laterally into contact with each other so that first complementary member 402 and the second complementary member 404 achieve the position indicated in FIG. 4*b*.

Figure 4B:
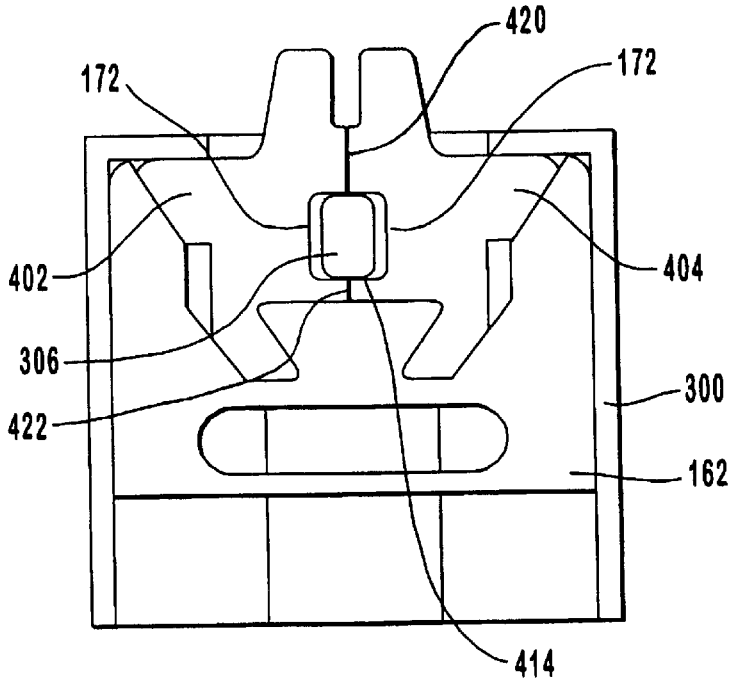
FIG. 4*b* is a partial elevation view of the structure of FIG. 4*a* in its fully extended position wherein the complementary portions of the insulation anvil have been moved together and have ascended to their point of maximum vertical travel.
Figure 4C:
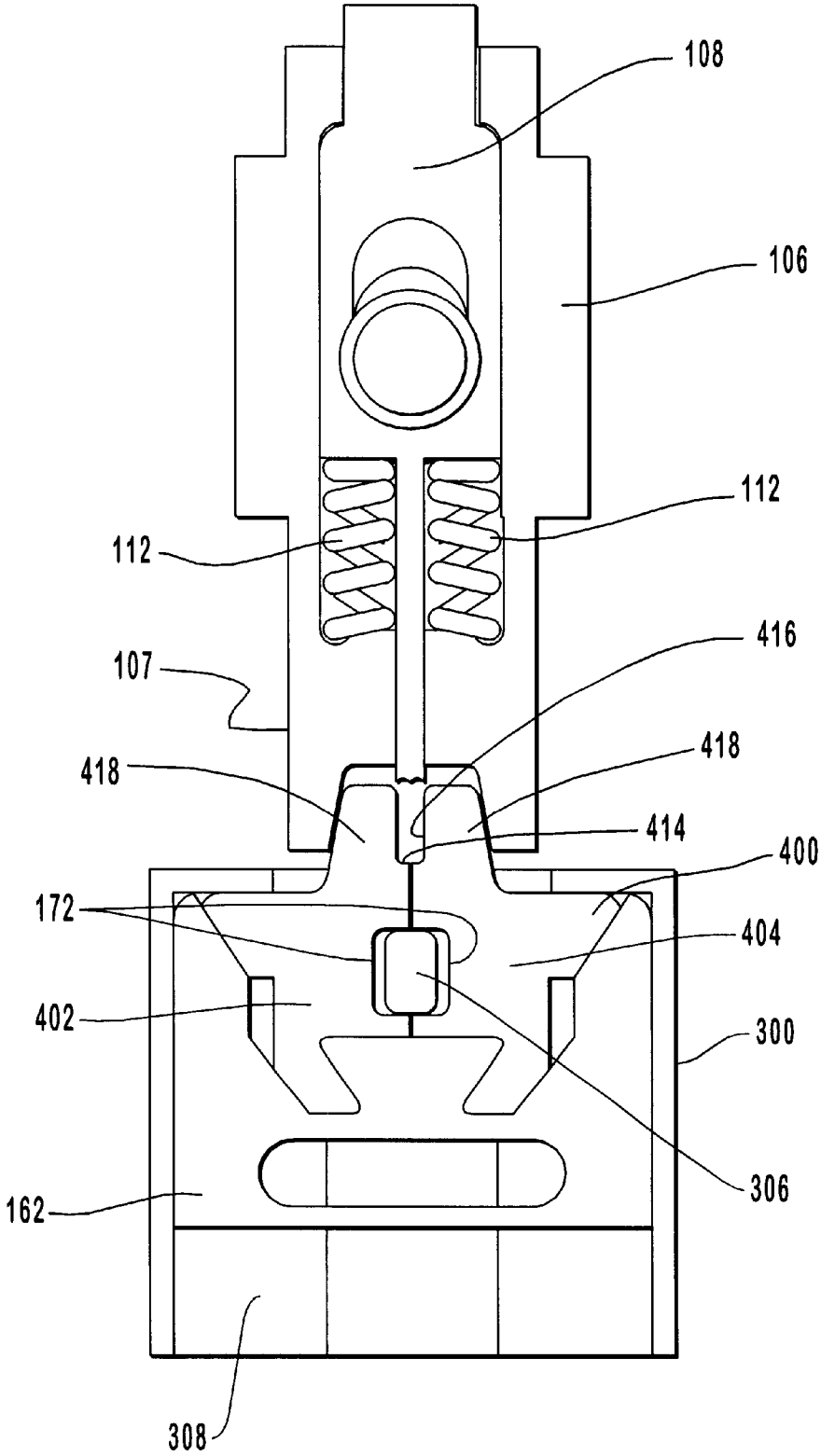
FIG. 4*c* is a partial elevation view of the structure of FIG. 4*b* and additionally depicts the insulation blade housing engaging the insulation anvil preparatory to crimping.

As depicted in FIGS. 4*b* and 4*c*, first complementary member 402 and second complementary member 404 of insulation anvil 400 each comprise cutout portions 172 which close together around center post 306 to form insulation anvil surface 414. As illustrated in FIG. 4*f*, first complementary member 402 and second complementary member 404 of insulation anvil 400 move laterally into contact with each other in response to the force exerted by cam 162 and come to rest at contact surfaces 420 and 422 (see FIG. 4C). A core anvil surface 512 is similarly formed and situated with respect to center post 306.

Figure 4D:
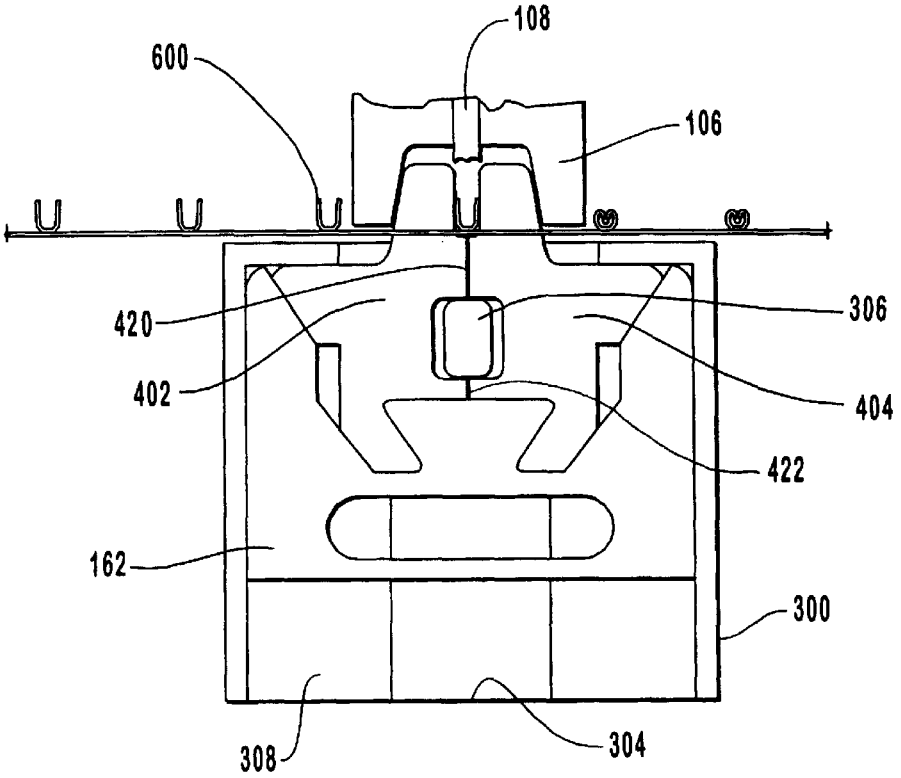
FIG. 4*d* is a partial elevation view of the structure of FIG. 4*c* showing the disposition of one embodiment of a terminal therein immediately prior to crimping.
Figure 4E:
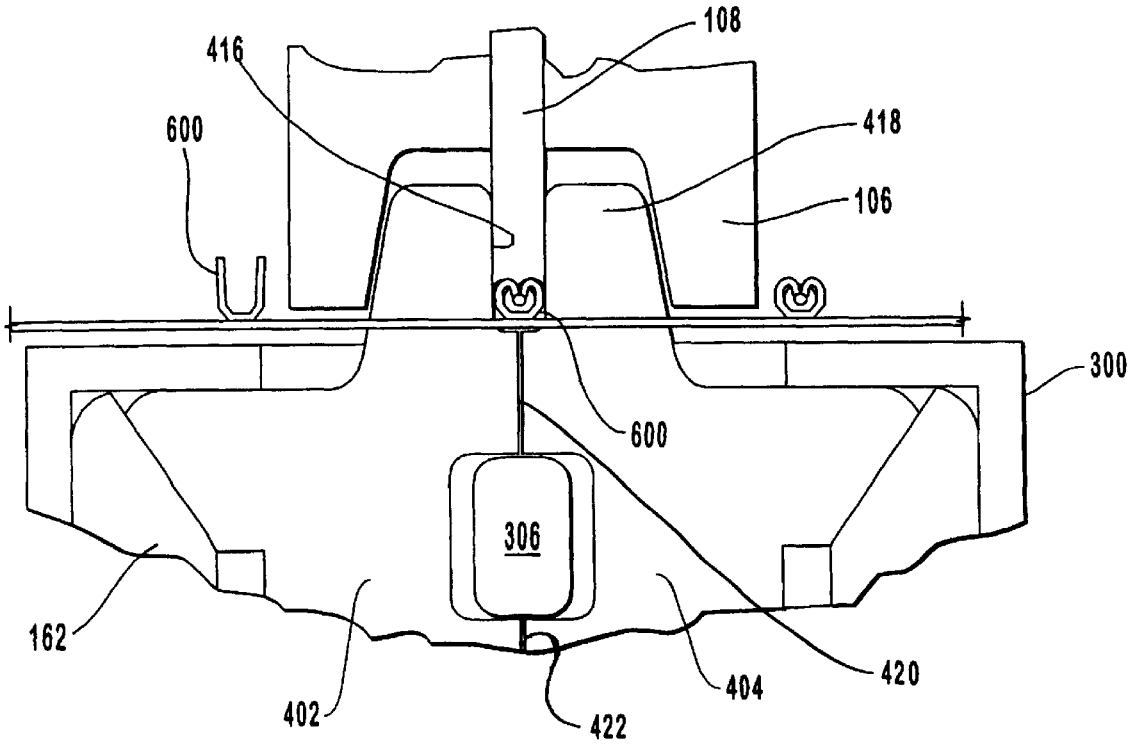
FIG. 4*e* is a partial elevation view of the structure of FIG. 4*d* showing complementary portions of the insulation anvil and the insulation blade in their fully extended position thereby crimping the terminal.
Figure 4F:
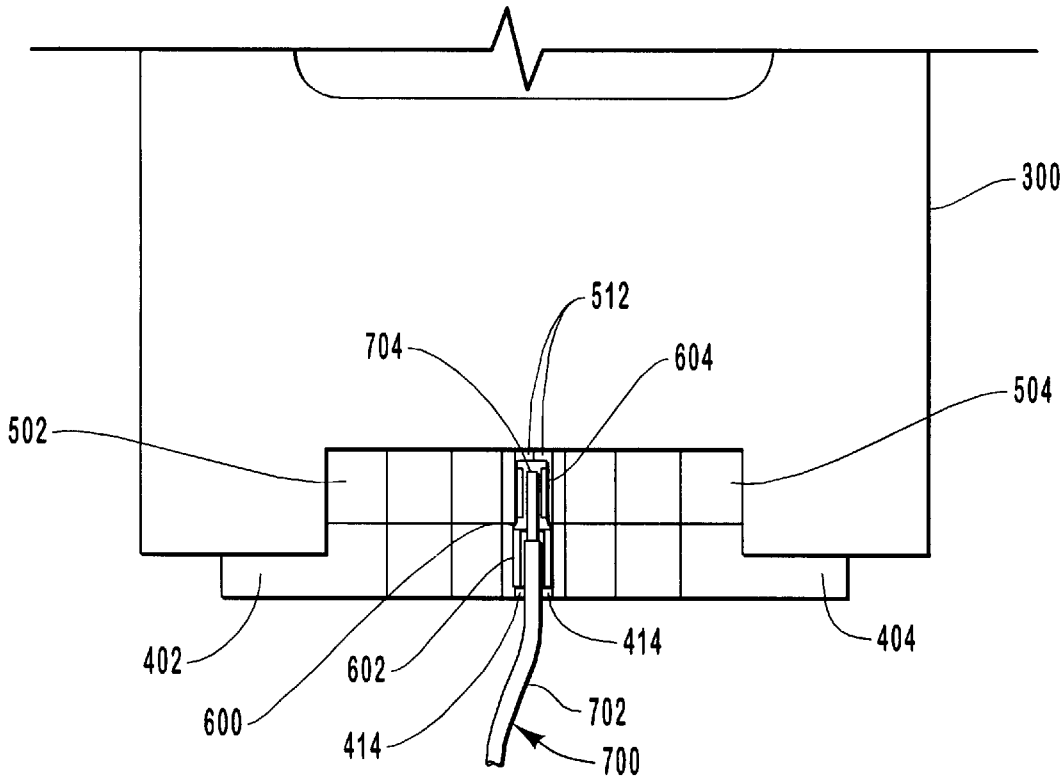
FIG. 4*f* is a plan view of one embodiment of the insulation anvil and core anvil.

With reference now to FIGS. 4*d* and 4*e*, substantially simultaneously with contact between first complementary member 402 and second complementary member 404 of insulation anvil 400, the sides of terminal 600 are caught and pinched slightly between those members. Insulation blade housing 106 then descends and slidingly engages insulation anvil 400 so as to prevent first complementary member 402 and second complementary member 404 of insulation anvil 400 from moving apart during crimping. After first complementary member 402 and second complementary member 404 of insulation anvil 400 are fully engaged by insulation blade housing 106, insulation blade 108 descends towards insulation anvil surface 414 until reaching its selected height. As depicted in FIG. 4*e*, insulation blade 108 is guided downwards towards terminal 600 by interior surfaces 416 of insulation anvil sidewalls 418.

Having described the operation of the individual elements of the inventive applicator die, the general crimping method employed by the inventive applicator die can now be briefly summarized, with reference to the various figures, as follows. Prior to the crimping process, applicator housing 102 is in the retracted position (see FIG. 2). Terminal 600 is then moved into position, by means well known in the art, so as to be aligned with insulation blade 108 and core blade 132 (not shown) (see FIG. 4*d*). Terminals 600 crimped by the present invention as disclosed herein comprise, in one embodiment, an insulation segment 602 and a core segment 604 (see FIG. 4*f*). Upon positioning of terminal 600, a lead wire 700 is inserted into terminal 600 by means well known in the art. Next, applicator housing 102 begins its descent towards insulation anvil 400 and core anvil 500, thereby pressing an insulated portion 702 of lead wire 700 into insulation segment 602 of terminal 600 and simultaneously pressing stripped portion 704 of lead wire 700 into core segment 604 of terminal 600 (see FIG. 4*f*). After lead wire 700 has been thus positioned with respect to terminal 600, complementary members 402 and 404 of insulation anvil 400 and complementary members 502 and 504 of core anvil 500 move upwards and together, under the influence of cam 162, to grasp terminal 600 and pinch it slightly. Thus positioned, insulation anvil 400 and core anvil 500 prevent terminal 600 from moving or rotating out of position during crimping, and press shoe assembly 148 (see FIG. 3) ensures that insulation anvil 400 and core anvil 500 remain in this position until crimping is complete. Upon being grasped by complementary members 402 and 404 of insulation anvil 400 and complementary members 502 and 504 of core anvil 500, terminal 600 comes to rest on insulation anvil surface 414 and core anvil surface 512 (see FIGS. 4*e* and 4*f*). Note that in one embodiment, core anvil surface 512 and insulation anvil surface 414 have substantially the same cross section, and abut each other so as to form a single continuous surface. After terminal 600 is thus positioned and secured, it is crimped about lead wire 700 by insulation blade 108 (FIG. 4*e*) and core blade 132 (FIG. 2). In particular, insulation blade 108 crimps insulation segment 602 of terminal 600 about insulated portion 702 of lead wire 700, and core blade 132 simultaneously crimps core segment 604 of terminal 600 about stripped portion 704 of lead wire 700. A close fit between interior surfaces 416 of insulation anvil sidewalls 418 and insulation blade 108 (see FIG. 4*e*), desirably ensures that no portion of terminal 600 is extruded past insulation blade 108 during crimping.

As illustrated in FIG. 4*e*, in one embodiment, insulation blade 108 and core blade 132 (not shown) are configured such that the crimp formed thereby is substantially B-shaped in cross section. However, it is contemplated that insulation and core blades may, individually and collectively, comprise a wide range of geometries. The present invention is not necessarily limited to those geometries which produce a B-shaped crimp cross section.

The applicator force is released after crimping and applicator ram (not shown) retracts applicator housing 102 to the resting position. When applicator housing 102 moves to the resting position, the force applied to cam lever 156 by press shoe assembly 148 is released substantially simultaneously, and the force applied to cam lever 156 by restoration spring 149 acts to rotate cam lever 156 in such a way that cam 162 is moved down to the retracted position inside cam housing 300.

Figure 5A:
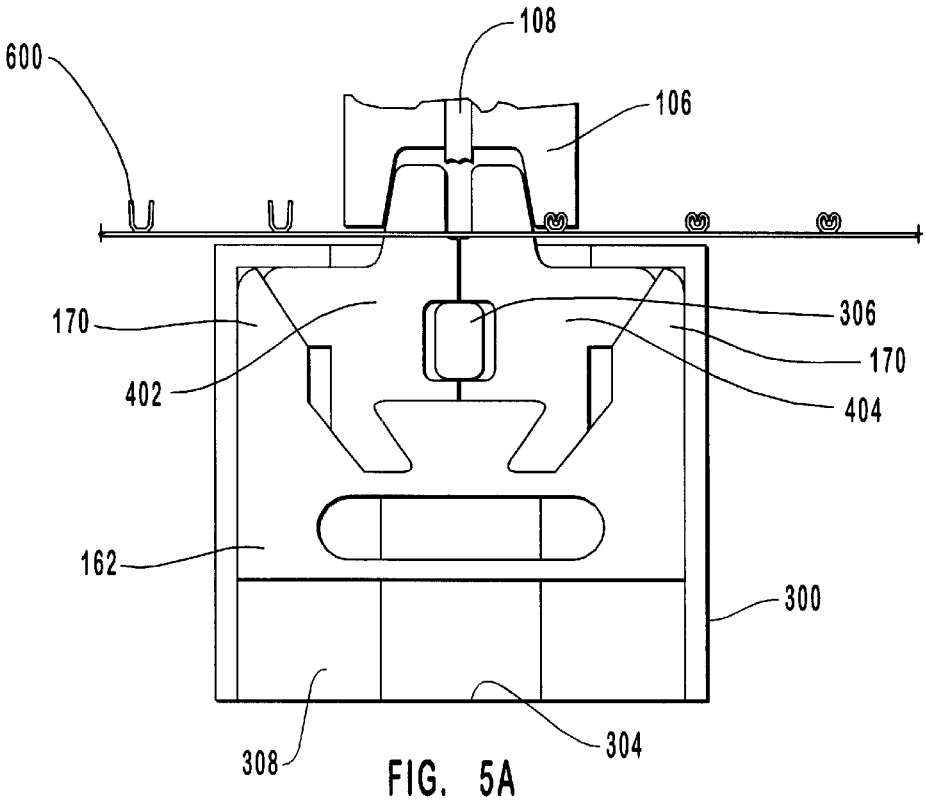
FIG. 5*a* is a partial elevation view of the structure of FIG. 4*e* with the insulation blade retracted immediately after crimping.

Attention is directed now to FIG. 5*a* which depicts insulation anvil 400 immediately after crimping has occurred. Core anvil 500 is not shown but reposes in a substantially similar orientation. As cam 162 moves to the retracted position under the influence of the force exerted by restoration spring 149 (see FIG. 3), inclined sides 166 of engaging member 164 of cam 162 slidingly exert a force, having both horizontal and vertical components, on first control surface 406 and second control surface 408 of insulation anvil 400, as suggested by FIG. 5*b*. Center post 306 initially prevents downward movement of first complementary member 402 and second complementary member 404. Consequently, only the horizontal component of the force exerted by cam 162 is initially efficacious.

Figure 5B:
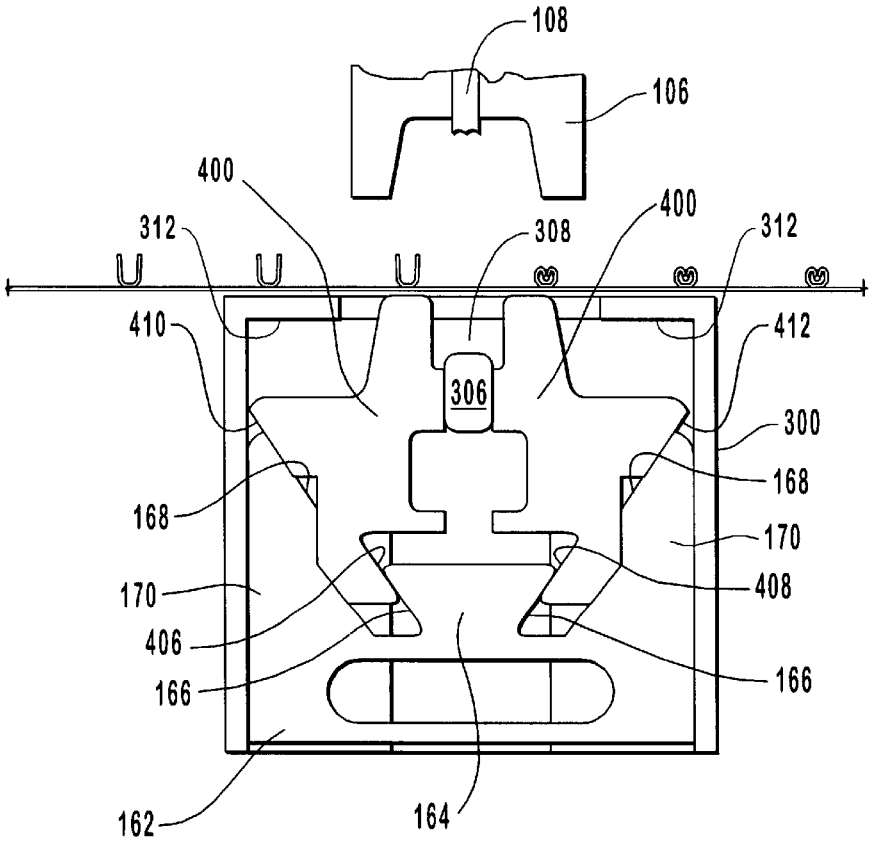
FIG. 5*b* is a partial elevation view of the structure of FIG. 5*a* after the complementary portions of the insulation anvil have reached their point of maximum horizontal travel and just prior to their retreat to the floor of the cam housing under the influence of the cam.

In particular, FIG. 5*b* indicates that the horizontal component of the force exerted by cam 162 acts to laterally move first complementary member 402 and second complementary member 404 of insulation anvil 400 apart from each other, the outer range of lateral motion being defined by cam housing 300. Lateral motion of first complementary member 402 and second complementary member 404 is facilitated by the downward retreat of arms 170 of cam 162. As previously noted, arms 170 cooperate with center post 306 to prevent lateral movement of first complementary member 402 and second complementary member 404 when cam 162 is in the extended position.

With continuing reference to FIG. 5*b*, at the same time that first complementary member 402 and second complementary member 404 have cleared center post 306, first complementary member 402 and second complementary member 404 come into contact with cam housing 300. Cam housing 300 thus acts to resist the horizontal component of the force exerted by cam 162 on first control surface 406 and second control surface 408. Upon coming into contact with cam housing 300, first complementary member 402 and second complementary member 404 of insulation anvil 400 are no longer responsive to the horizontal component of the force exerted by cam 162. Accordingly, only the vertical component of the force exerted by cam 148 is now efficacious with respect to first complementary member 402 and second complementary member 404 of insulation anvil 400. Specifically, the vertical component of the force exerted by cam 162 acts on first control surface 406 and second control surface 408 of insulation anvil 400 so as to move first complementary member 402 and second complementary member 404 downward until cam 162 reaches the retracted position.

Finally, as suggested in FIG. 5*b*, once the retracted position is reached, motion of first complementary member 402 and second complementary member 404 ceases. First complementary member 402 and second complementary member 404 of insulation anvil 400 and first complementary member 502 and second complementary member 504 of core anvil 500 are thus placed in a second position, indicated in FIG. 5*b* in which insulation anvil surface 414 and core anvil surface 512 (FIG. 4*f*) are no longer present or defined. First and second complementary members 402 and 404, respectively, and first and second complementary members 502 and 504, respectively then repose in the second position until it is desired to perform the crimping process again.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed and desired to be secured by United States Letters Patent is:

1. A crimping applicator, comprising:

(a) an applicator housing;

(b) means for selectively applying an applicator force to said applicator housing;

(c) a plurality of blades disposed inside said applicator housing, each of said plurality of blades being operably connected to said applicator housing so as to move in response to said applicator force; and (d) a plurality of anvils operably connected to said means for selectively applying an applicator force to said housing, each of said plurality of anvils having a first position in which said plurality of blades transmit said applicator force to a plurality of components and a second position in which said plurality of blades are retracted.

2. The crimping applicator as recited in claim 1, wherein when said plurality of anvils are in said first position said plurality of components are gripped by said plurality of anvils.

3. The crimping applicator as recited in claim 1, wherein when said plurality of anvils are in said second position said components are released.

4. The crimping applicator, as recited in claim 1, wherein said plurality of blades comprises a first blade and a second blade.

5. The crimping applicator as recited in claim 4, wherein said plurality of anvils comprise a first anvil selectively configured to removably receive said first blade and a second anvil selectively configured to removably receive said second blade.

6. The crimping applicator as recited in claim 4, wherein said first anvil and said second anvil assume said first position in response to said applicator force.

7. The crimping applicator as recited in claim 1, wherein each of said plurality of anvils comprises a first and second complementary member.

8. The crimping applicator as recited in claim 1, wherein said means for selectively applying a applicator force comprises an applicator ram.

9. The crimping applicator as recited in claim 1, wherein said component comprises a terminal.

10. A crimping applicator, comprising:

(a) an applicator housing;

(b) means for selectively applying an applicator force to said applicator housing;

(c) a plurality of blade housings attached to said applicator housing so as to move in response to said applicator force;

(d) a plurality of blades mounted in a corresponding one of said plurality of blade housings; and (e) a plurality of anvils operably connected to said means for selectively applying an applicator force to said applicator housing, said plurality of anvils having a first position in which each of said plurality of anvils removably receive one of said plurality of blades, and a second position where said plurality of blades are retracted from said plurality of anvils.

11. The crimping applicator, as recited in claim 10, wherein when said plurality of anvils is in said first position one of said plurality of anvils is releasably engaged by one of said plurality of blade housings.

12. The crimping applicator as recited in claim 10, wherein in said first position said plurality of blades transmit said applicator force to a component gripped by said plurality of anvils.

13. The crimping applicator, as recited in claim 10, further comprising means for moving said plurality of anvils between said second position to said first position.

14. The crimping applicator as recited in claim 10, wherein each of said plurality of blades comprise a crimping surface.

15. The crimping applicator, as recited in claim 14, wherein each of said plurality of anvils comprise an anvil surface, configured to cooperate with said crimping surface so as to define a crimp height when said plurality of blades are fully received in said plurality of anvils.

16. The crimping applicator as recited in claim 15, further comprising means for adjusting said crimp height.

17. The crimping applicator as recited in claim 16, wherein said means for adjusting said crimp height comprises a pair of sliding cams.

18. The crimping applicator according to claim 15, wherein each of said plurality of blades have a geometry that creates a crimp having a substantially B-shaped cross section after application of said applicator force.

19. A crimping applicator, comprising:

(a) an applicator housing;

(b) an applicator ram operatively connected with said applicator housing so that said applicator housing is extended in response to said applicator force and said applicator housing is retracted when said applicator force is released;

(c) a blade housing connected to said applicator housing;

(d) a blade movably mounted in said first blade housing, said blade being configured to move in response to said applicator force; and (e) an anvil comprising a pair of complementary members, said anvil having a first position in which said anvil is releasably engaged by said blade housing to removably receive said blade therein said blade thereby transmitting said applicator force to component gripped by said anvil and a second position where said blade housing disengages said anvil and said blade is retracted from said anvil.

20. The crimping applicator, as recited in claim 19, wherein when said anvil is in said first position said complementary members of said anvil cooperate.

21. The crimping applicator, as recited in claim 20, wherein when said anvil is in said second position said blade housing disengages said anvil.

22. The crimping applicator, as recited in claim 21, further comprising means for moving said anvil to said first position in response to said applicator force and moving said anvil to said second position when said applicator force is released.

* * * * *